United States Patent [19]

Hüttemann

[11] Patent Number: 4,862,712

[45] Date of Patent: Sep. 5, 1989

[54] TOP-LOADING DRUM-TYPE WASHING MACHINE

[75] Inventor: Wilfried Hüttemann, Bielefeld, Fed. Rep. of Germany

[73] Assignee: Miele & Cie GmbH & Co., Fed. Rep. of Germany

[21] Appl. No.: 270,704

[22] Filed: Nov. 14, 1988

[30] Foreign Application Priority Data

Nov. 13, 1987 [DE] Fed. Rep. of Germany ..... 3738613

[51] Int. Cl.[4] ..... D06F 37/10

[52] U.S. Cl. ..... 68/17 R; 68/139

[58] Field of Search ..... 68/17 R, 139

[56] References Cited

FOREIGN PATENT DOCUMENTS

| | | | |
|---|---|---|---|
| 2631750 | 1/1977 | Fed. Rep. of Germany | 68/139 |
| 3310279 | 9/1984 | Fed. Rep. of Germany | 68/139 |
| 3431807 | 3/1986 | Fed. Rep. of Germany | 68/139 |
| 2487870 | 2/1982 | France | 68/17 R |

*Primary Examiner*—Philip R. Coe

*Attorney, Agent, or Firm*—Nils H. Ljungman

[57] ABSTRACT

A preferred drum-type washing machine includes a housing having an interior and a housing lid which is placed in an open position for access to the interior. A detergent container is disposed within the interior of the housing and includes a detergent container lid which is aligned with the housing lid. The detergent container lid is for access to an interior of the detergent container when in an open position when the housing lid is in the open position. A wash drum is mounted for rotation about a horizontal axis within the interior of the detergent container. The wash drum includes a drum lid which is for alignment with the detergent container lid and, when in the open position, allows access to the interior of the drum. The drum lid is in a closed position for rotation of the wash drum. There is included a positioning device for positioning the drum in a loading position at which the drum lid is aligned with the detergent container lid. The position device is actiavated when the housing lid is in an open position. There is also included a device for opening the detergent container lid when the position device has positioned the drum in a loading position.

9 Claims, 1 Drawing Sheet

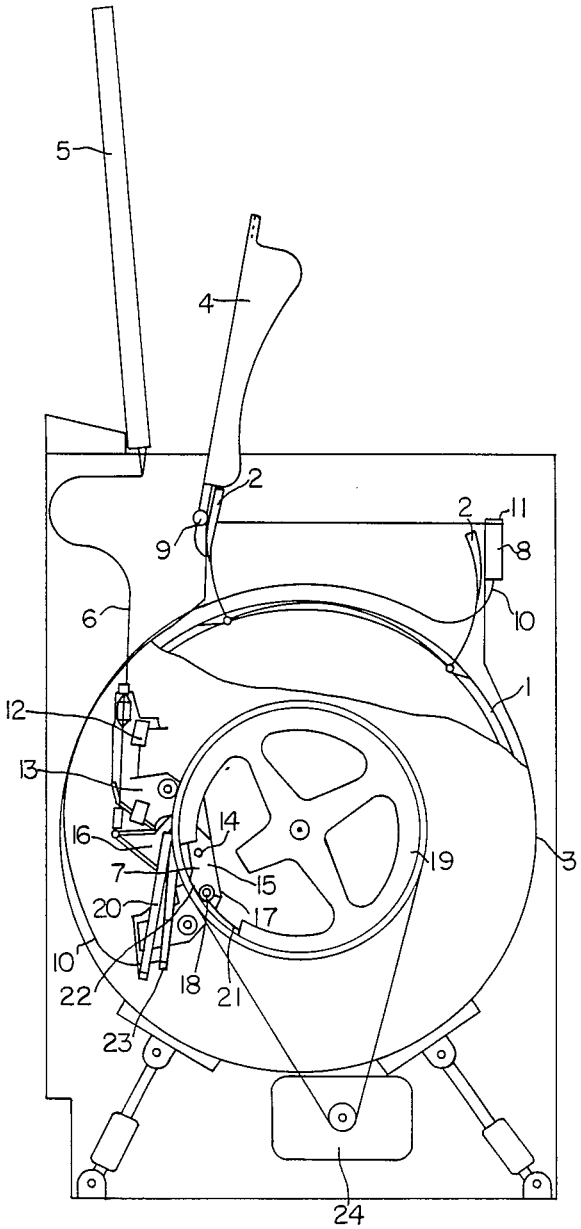
5
4
2
2
11
9
8
6
10
1
12
13
14
16
7
15
19
3
20
17
10
22
18
21
23
24

TOP-LOADING DRUM-TYPE WASHING MACHINE

BACKGROUND OF THE INVENTION

1. Field of the Invention:

This invention relates to a top-loading drum-type washing machine with a housing lid, a detergent container lid and a drum lid, and, more specifically, to such a washing machine which includes a positioning apparatus which puts the drum in the loading position, and in which the housing lid is connected with the positioning apparatus so that the washing drum is automatically put in the loading position when the housing lid is opened.

2. Description of the Prior Art:

German Laid Open Patent Appln. No. 26 31 750 describes a top-loading drum-type washing machine of the type described above, in which three different lids must be opened to gain access to the interior of the drum. Because such an opening procedure is a nuisance and a waste of time, there remains a need for any such washing machine which is easier and more convenient to use.

OBJECT OF THE INVENTION

It is therefore an object of the invention to provide a top-loading drum-type washing machine including the different lids which are at least partly automated to simplify the opening process thereof.

SUMMARY OF THE INVENTION

This and other objects of the invention are provided in a preferred drum-type washing machine including a housing having an interior and a housing lid which is placed in an open position for access to the interior. A detergent container is disposed within the interior of the housing and includes a detergent container lid which is aligned with the housing lid. The detergent container lid is for access to an interior of the detergent container when in an open position when the housing lid is in the open position. A wash drum is mounted for rotation about a horizontal axis within the interior of the detergent container. The wash drum includes a drum lid which is for alignment with the detergent container lid and, when in the open position, allows access to the interior of the drum. The drum lid is in a closed position for rotation of the wash drum. There is included a positioning device for positioning the drum in a loading position at which the drum lid is aligned with the detergent container lid. The position device is activated when the housing lid is in an open position. There is also included a device for opening the detergent container lid when the position device has positioned the drum in a loading position.

As a result of the arrangement of the lids and the transmission elements, access to the interior of the drum is easier in the preferred drum-type washing machine. The essential advantage of the invention is that it enables the user to only open a maximum of two lids of the drum-type washing machine to gain access to the interior of the drum.

BRIEF DESCRIPTION OF THE DRAWING

FIG. 1 includes a simplified, sectional view of a preferred top-loading drum-type washing machine including various features of the invention.

DESCRIPTION OF THE PREFERRED EMBODIMENT

As seen in FIG. 1, a preferred top-loading drum-type washing machine includes a housing, a detergent container 3 mounted within the housing, and a washing drum 1 mounted for rotation about a horizontal axis within the detergent container 3. The various components of the washing machine are shown in a position for loading the washing drum 1. A drum lid 2 is shown in the open position but is closed to allow the washing drum 1 to rotate in the detergent container 3 during washing. The detergent container 3 includes a detergent container lid 4 which is to be closed after loading the washing drum 1 and during the wash cycle. The housing of the top-loading drum-type washing machine includes a housing lid 5, again shown in the opened position, to provide access to the aligned detergent container lid 4 but will again be closed during the washing cycle.

A Bowden wire 6 is shown generally in FIG. 1 to extend between the housing lid 5 and a positioning apparatus 7 to cause movement of the positioning apparatus 7 in response to movement of the housing lid 5. A Bowden wire, which is well known in the prior art as a transmission element, includes a spring steel wire enclosed in a spiral wire or similar casing for transmitting longitudinal motion at a distance through a curved path. The spring steel wire is positioned in one direction when the housing lid 5 is opened and in an opposite direction when the housing lid 5 is closed. Accordingly, when the housing lid 5 is opened, relative longitudinal movement of the wire in the casing of the Bowden wire 6 causes the positioning apparatus 7 to be urged toward the pulley 19 of the washing drum 1 to bring the washing drum 1 into its loading position as shown in FIG. 1.

With the housing lid 5, the detergent container lid 4, and the washing drum lid 2 in the open position, the washing drum 1 can be loaded. After the washing drum 1 is loaded, the drum lid 2 can be closed by hand. In the preferred washing machine, the detergent container lid 4 is mounted on a biased hinge 9 which may include a gas compression spring, a spring loaded hinge, or similar device. Accordingly, the detergent container lid 4 is closed by the operator against biasing to allow a locking mechanism 8 to maintain the detergent container lid 4 in a locked position during washing. The locking mechanism 8 includes a mechanical or electrical pulse generator which is employed to deactivate the locking mechanism 8 in a manner to be discussed hereinbelow. Closure of the housing lid 5 will reposition the internal wire of the Bowden wire 6 to deactivate the positioning apparatus 7 and release the washing drum 1 for rotation during the washing cycle.

After a washing cycle is completed, the housing lid 5 can be opened in the manner discussed above. Upon activation of the positioning apparatus 7, the preferred washing machine includes means for automatically opening the detergent container lid 4. Specifically, a preferred opening system includes an additional Bowden wire 10 which is provided to generally extend between the positioning apparatus 7 and the locking mechanism 8. When the washing drum 1 is returned to its loading position, the relative longitudinal movement of the wire in the casing of the Bowden wire 10 will cause activation of the mechanical or electrical pulse generator in the locking mechanism 8. Activation of the pulse generator within the locking mechanism 8 will open a lid lock 11 and release the detergent container lid 4. When the detergent container lid 4 is released, the biased hinge 9 will automatically urge the detergent container lid 4 to the open position. With the detergent container lid 4 opened in this manner, the operator of the preferred washing machine must simply open the drum lid 2 by hand for access to the interior of the washing drum 1 for subsequent unloading and reloading.

More specifically, the preferred positioning apparatus 7 consists essentially of a base plate 13 fastened on the detergent container 3 and a rocker arm 15 mounted on the base plate 13 for pivoting around a fulcrum 14. The rocker arm 15 includes a first lever arm 16 which is connected with the housing lid 4 by means of the movable wire within the Bowden wire 6. The other lever arm 17 of the rocker arm 15 supports a feeler element 18, which is engaged from behind in the cup-shaped pulley 19.

A tension spring 20 is disposed between the first lever arm 16 of the rocker arm 15 and the base plate. When the housing lid 5 is opened, the Bowden wire 6 is activated, and the rocker arm 15 moves against the spring force of the spring 20 around the fulcrum 14. It would be possible to configure the first lever arm 16, the spring 20, and the rocker arm 15 so that initial movement of the Bowden wire 6 would create biasing on the rocker arm 15 tending to urge the rocker arm 15 under biasing toward the pulley 19.

As a result of this movement of the rocker arm 15, a feeler element 18 on the rocker arm 15 is brought into contact with a circular positioning rail 21 of the pulley 19. The movement of the rocker arm 15 also activates a switch 12 which applies voltage to the drive motor 24 to cause the washing drum 1 to be driven at a low rotational speed. The feeler element 18 thereby rides against or feels the positioning rail 21 of the pulley 19 during the rotation thereof. The positioning rail 21 includes a recess 22, in which the feeler element 18 engages as soon as the opening of the drum 1 is in the loading position. When the feeler element 18 is engaged in the recess 22, the drive motor 24 is disconnected.

As a result of the engagement of the feeler element 18 in the recess 22 and the related pivoting movement of the rocker arm 15, a trip lever 23 is activated. The trip lever 23 is connected to the movable internal wire of the Bowden wire 10 so that the trip lever 23 in turn activates the Bowden wire 10. By means of the Bowden wire 10, a pulse is transmitted by the pulse generator within the locking mechanism 8 so that the lid lock 11 is unlocked. As mentioned above, the pulse generator may be mechanical as the wire within the Bowden wire 6 physically moves the elements of the lid lock 11 to an unlocked position. On the other hand, the pulse generator might be electrical to activate or deactivate an electrical solenoid or the like to unlock the lid lock 11. In either case, because of the spring-loaded hinge 9, the detergent container lid 4 opens automatically, and the drum lid 2 can be opened by hand.

In the context of the invention, a series of different configurations are conceivable. For example, as described in German Laid Open Patent Appln. No. 34 31 807, the distance travelled by a catch element of a positioning apparatus disclosed therein can be used to activate a Bowden wire or similar position transmitting device to generate a mechanical or electrical pulse to unlock the detergent container lid.

The invention as described hereinabove in the context of a preferred embodiment is not to be taken as limited to all of the provided details thereof, since modifications and variations thereof may be made without departing from the spirit and scope of the invention.

What is claimed is:

1. A top-loading drum-type washing machine comprising:

a housing having an interior thereof;

said housing having a housing lid which can be placed in an open position for access to said interior of said housing;

a detergent container disposed within said interior of said housing;

said detergent container including a detergent container lid which is aligned with said housing lid;

said detergent container lid being for access to an interior of said detergent container in an open position when said housing lid is in said open position;

a wash drum mounted for rotation about a horizontal axis within said interior of said detergent container;

said wash drum including a drum lid which is for alignment with said detergent container lid;

positioning means for positioning said drum in a loading position at which said drum lid is aligned with said detergent container lid;

said drum lid being in an open position for access to an interior of said drum when in said loading position and in a closed position for said rotation of said wash drum;

activating means for activating said positioning means when said housing lid is in said open position; and opening means for opening said detergent container lid when said positioning means is activated.

2. A top-loading drum-type washing machine according to claim 1, wherein said detergent container includes a locking means for locking said detergent container lid in a closed position.

3. A top-loading drum-type washing machine according to claim 2, wherein said opening means includes a movement transmitting means between said positioning means and said locking means.

4. A top-loading drum-type washing machine according to claim 3, wherein said movement transmitting means includes wire for longitudinal movement within a casing.

5. A top-loading drum-type washing machine according to claim 2, wherein said opening means includes a pulse generator within said locking means for releasing said detergent container lid from said closed position.

6. A top-loading drum-type washing machine according to claim 5, wherein said pulse generator is at least one of a mechanical pulse generator and an electrical pulse generator.

7. A top-loading drum-type washing machine according to claim 1, wherein said opening means includes a means for biasing said detergent container lid toward said open position.

8. A top-loading drum-type washing machine according to claim 7, wherein said means for biasing includes a biased hinge of said detergent container lid.

9. A top-loading drum-type washing machine according to claim 8, wherein said opening means includes means for releasing said detergent container lid from a closed position.

* * * * *